United States Patent [19]

White et al.

[11] Patent Number: 5,060,669

[45] Date of Patent: Oct. 29, 1991

[54] TOBACCO TREATMENT PROCESS

[75] Inventors: Jackie L. White, Pfafftown; Milly M. L. Wong, Winston-Salem; Chi-Kuen Shu, Winston-Salem; Thomas A. Perfetti, Winston-Salem, all of N.C.

[73] Assignee: R. J. Reynolds Tobacco Company, Winston-Salem, N.C.

[21] Appl. No.: 452,175

[22] Filed: Dec. 18, 1989

[51] Int. Cl.[5] ..... A24B 15/18; A24B 15/24; A24B 15/26

[52] U.S. Cl. ..... 131/297; 131/298; 131/309; 131/310

[58] Field of Search ..... 131/309, 310, 290, 297, 131/298

[56] References Cited

U.S. PATENT DOCUMENTS

| | | |
|---|---|---|
| 3,174,485 | 3/1965 | Griffith et al. . |
| 3,316,919 | 5/1967 | Green et al. . |
| 3,398,754 | 8/1968 | Tughan . |
| 3,424,171 | 1/1969 | Rooker . |
| 3,803,004 | 4/1974 | Egri . |
| 3,894,543 | 7/1975 | Anderson et al. . |
| 4,150,677 | 4/1979 | Osborne, Jr. et al. . |
| 4,244,381 | 1/1981 | Lendvay . |
| 4,256,123 | 3/1981 | Lendvay et al. . |
| 4,497,330 | 2/1985 | Banyasz et al. . |
| 4,506,682 | 3/1985 | Muller . |
| 4,596,259 | 6/1986 | White et al. . |
| 4,607,646 | 8/1986 | Lilly, Jr. et al. . |
| 4,638,816 | 1/1987 | Cox et al. . |
| 4,714,082 | 12/1987 | Banerjee et al. . |
| 4,744,375 | 5/1988 | Denier et al. . |
| 4,756,318 | 7/1988 | Clearman et al. . |
| 4,793,365 | 12/1988 | Sensabaugh, Jr. et al. . |
| 4,819,668 | 4/1989 | Shelar et al. . |
| 4,825,884 | 5/1989 | Denier et al. . |
| 4,827,949 | 5/1989 | Sunas . |

FOREIGN PATENT DOCUMENTS

| | | |
|---|---|---|
| 72/3935 | 6/1972 | South Africa . |

OTHER PUBLICATIONS

*J. Agr. Food Chem.*, Roeraade et al., vol. 20, No. 5, p. 1035.

*18th Tob. Chem. Res. Conf.*, Johnson et al., (1964).

*Primary Examiner*—V. Millin

[57] ABSTRACT

Flavorful tobacco extracts are provided by subjecting a moist spray dried tobacco extract to heat treatment. The moist extract is contacted with a sugar and an amino acid, and exposed to a temperature above about 100° C. in a pressure controlled vessel. Resulting flavorful extracts are useful as forms of tobacco in cigarettes and other smoking articles.

21 Claims, 1 Drawing Sheet

TOBACCO TREATMENT PROCESS

BACKGROUND OF THE INVENTION

The present invention relates to flavorful forms of tobacco for cigarettes and other types of smoking articles, and in particular, to processes for providing such flavorful forms of tobacco.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al; 4,756,318 to Clearman et al; and 4,793,365 to Sensabaugh, Jr. et al; and European Patent Publication Nos. 212,234 and 277,519 propose cigarettes and pipes which comprise a fuel element, an aerosol generating means physically separate from the fuel element, and a separate mouthend piece. Such types of smoking articles provide natural tobacco flavors to the smoker thereof by heating, rather than burning, tobacco in various forms. As natural tobacco flavors are important components of smoking articles in order that such smoking articles can provide adequate tobacco taste and aroma, improved processes for providing natural tobacco flavor substances and flavorful forms of tobacco are desirable.

It would be highly desirable to provide a process for efficiently and effectively producing flavorful forms of tobacco.

SUMMARY OF THE INVENTION

The present invention relates to a process for providing flavorful natural tobacco substances which are useful forms of tobacco for various types of cigarettes and other smoking articles. In particular, a tobacco extract is subjected to heat treatment (i.e., a moderately high temperature treatment) under conditions sufficient to alter the chemical nature (e.g., the flavor and aroma characteristics) of the extract. Normally, the tobacco extract is exposed to a temperature sufficiently high and for a period of time sufficiently long so as to provide an extract which does not exhibit a "green" or harsh flavor. However, it is preferable that the tobacco extract not be exposed to such a high temperature for a sufficiently long period of time so as to provide an extract which exhibits a burnt, tarry, overly bitter or highly metallic flavor.

The tobacco extract is combined with an aqueous liquid and can be carried by a substrate during the time that the extract undergoes the moderately high temperature treatment. In addition, moist tobacco extract can be combined with an organic liquid (e.g., glycerin) prior to the time that the tobacco extract is subjected to the moderately high temperature treatment. Thus, for purposes of the present invention, it is convenient to refer to the heat treatment, or the moderately high temperature treatment, of a tobacco composition. For purposes of this invention, a tobacco composition can include (i) a tobacco extract and an aqueous liquid, (ii) a tobacco extract, an aqueous liquid, and a substrate which carries the extract and aqueous liquid, (iii) a tobacco extract, an aqueous liquid and an organic liquid, or (iv) a tobacco extract, an aqueous liquid, an organic liquid and a substrate for the extract and liquids. If desired, additives including at least one sugar and/or at least one amino acid can be incorporated into the tobacco composition.

More particularly, the present invention relates to a process for treating natural tobacco substances by subjecting a tobacco extract (e.g., an aqueous tobacco extract) to exposure to a temperature above about 100° C. The tobacco extract has a moisture content of at least about 5 weight percent, preferably at least about 15 weight percent, when that extract is exposed to the moderately high temperature treatment; and the tobacco extract is subjected to such treatment while enclosed in a pressure controlled environment. In general, the pressure experienced by the extract is greater than ambient (i.e., atmospheric) pressure. For purposes of this invention, the term "moisture content" relates to the weight of the water within the tobacco composition relative to the total weight of the tobacco composition. The tobacco extract normally is subjected to such treatment in order that the entire extract is exposed to a temperature above about 100° C. for at least about 10 minutes.

The flavorful tobacco substances so provided are useful as forms of tobacco for smoking products. For example, such flavorful tobacco substances are useful as casing or top dressing components for tobacco laminae and cut filler, as well as for other smokable materials. Alternatively, such flavorful tobacco substances are useful as one form of tobacco employed in those types of smoking articles described in U.S. Pat. Nos. 4,708,151 to Shelar; 4,714,082 to Banerjee et al; 4,756,318 to Clearman et al; and 4,793,365 to Sensabaugh et al; as well as European Patent Publication Nos. 212,234 and 277,519. The flavorful tobacco substances also are useful as cigarette filter additives. For example, the flavorful tobacco substances can be incorporated into low density polyethylene and formed into strands, and then incorporated into cigarette filters as described in U.S. Pat. Nos. 4,281,671 to Bynre et al and 4,862,905 to Green, Jr. et al. The flavorful tobacco substances also are useful as cigarette wrapper additives; or as additives to the inner regions of cigarette packages (e.g., within a paper/foil laminate of a cigarette package or within a low density polyethylene film which is placed within a cigarette package) in order to provide a desirable cigarette aroma and "pack aroma."

DETAILED DESCRIPTION OF THE PREFERRED EMBODIMENTS

Figure 1:
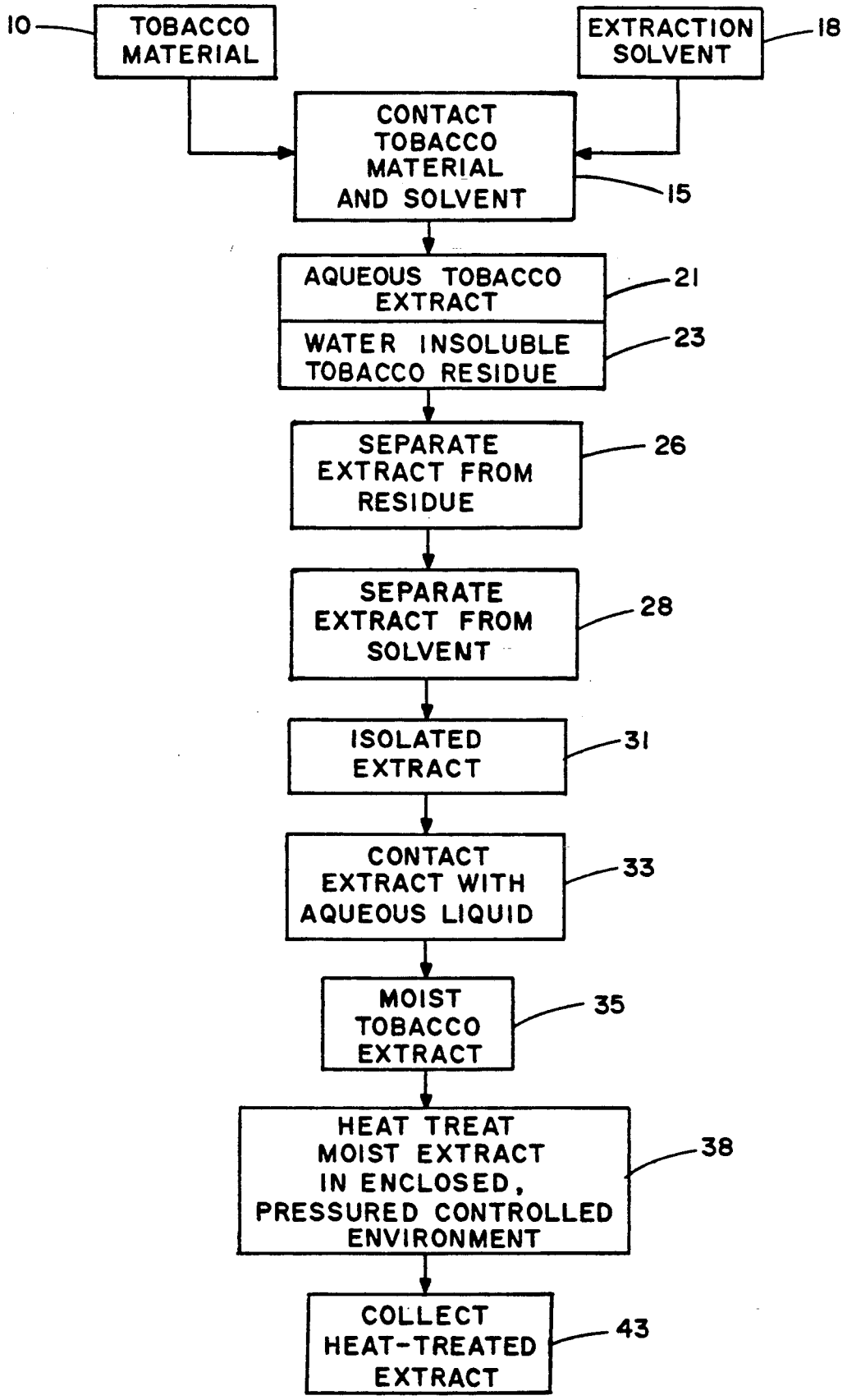
FIG. 1 is a schematic diagram of process steps representative of embodiments of the present invention.

Referring to FIG. 1, tobacco material 10 is contacted 15 with an extraction solvent 18 having an aqueous character. As such, various soluble components are extracted from the tobacco material 10 yielding an aqueous tobacco extract 21 and a water insoluble tobacco residue 23. The aqueous tobacco extract 21 is separated 26 from the insoluble residue 23 using centrifugation techniques, or the like. The extracted tobacco components are separated from the solvent by distillation techniques followed by spray drying techniques 28, or the like. The resulting isolated tobacco extract 31 is in a relatively low solvent form. The extract then is contacted 33 with a liquid having an aqueous character, such that a moist tobacco extract 35 is provided. The moist tobacco extract is subjected to a moderately high temperature treatment 38 in an enclosed, pressure controlled environment for a period of time sufficient to provide desirable flavor characteristics to the extract. The resulting heat-treated extract then is collected 43 for later use in the manufacture of cigarettes and other smoking articles.

The tobacco materials useful herein can vary. Tobacco materials which are used are of a form such that, under extraction conditions, a portion thereof is soluble in (i.e., extracted by) an extraction solvent; and a portion thereof is insoluble in (i.e., not extracted by) that extraction solvent. Examples of suitable types of tobaccos include flue-cured, Burley, Maryland and Oriental tobaccos, as well as the rare or specialty tobaccos. The tobacco material generally has been aged, and can be in the form of laminae and/or stem, or can be in processed form. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof.

A tobacco extract can be provided in a number of ways. In particular, the tobacco material is subjected to extraction conditions with a suitable solvent to extract a sufficient amount of the desired components from the tobacco material. The manner in which the tobacco material is extracted, and the type of solvent employed, can vary. For example, the tobacco material can be extracted using organic solvents (e.g., hexane, methanol or ethanol), halocarbons and halogenated hydrocarbons, supercritical fluids (e.g., supercritical carbon dioxide and supercritical sulfur hexafluoride), and the like. Preferably, the tobacco extract is provided by extracting the tobacco material using a liquid having an aqueous character. Such a liquid consists primarily of water, normally greater than about 90 weight percent water, and can be essentially pure water in certain circumstances. For example, a solvent having an aqueous character can be distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent mixture of water and minor amounts of one or more solvents which are miscible therewith.

Methods for extracting components from tobacco materials, separating extracts from unextracted tobacco materials, and isolating tobacco extracts will be apparent to the skilled artisan.

The tobacco extract can have various forms. For example, it is desirable to subject an aqueous extract to a spray drying, freeze drying, belt drying, flash drying, or other suitable solvent removal process in order to provide a tobacco extract in a substantially solvent-free form. As such, tobacco extracts can have the form of a paste, a viscous liquid, a powder, a granular solid, a gel, or the like. Tobacco extracts can be processed as described in European Patent Application Nos. 326,370 and 338,831. Typically, tobacco extracts are provided in the form of spray dried extracts, freeze dried extracts, tobacco essences, or the like.

For purposes of this invention, spray drying is a one-step continuous process for removing a liquid from a solution and producing a dried particulate form of the extracted components within the solution by spraying a feed of the solution into a hot drying medium. Representative spray drying processes are described in U.S. Pat. No. 3,398,754 to Tughan and European Patent Application No. 326,370. For purposes of this invention, freeze drying is an indirect, batch or continuous process for removing the liquid from a solution and producing a dried form of the extracted components by freezing the solution and drying the solution in a frozen state through sublimation under high vacuum. A representative freeze drying process is described in U.S. Pat. No. 3,316,919 to Green. Methods and conditions for providing extracted materials in a solid form (e.g., as a powder) will be apparent to the skilled artisan.

The extracted tobacco components can be provided at a predetermined solvent level (e.g., in a predetermined high moisture form) by evaporating the solvent from the mixture of solvent and extract. Vacuum distillation and thin film evaporation techniques are particularly preferred.

The tobacco extract is in contact with an aqueous liquid in order to provide a moist extract. Certain tobacco extracts which are extracted using an aqueous liquid may have a significant moisture content, and do not require further addition of aqueous liquid thereto. The manner of contacting a low moisture content tobacco extract with the aqueous liquid can vary and is not particularly critical. Typically, the extract and liquid are mixed using stirring or agitation, and often employing gentle heating.

The amount of water relative to the tobacco extract (i.e., the moisture content of the extract) can vary when the heat treatment step of the process of the present invention is performed. Typically, the moisture content of the extract is at least about 5 weight percent, normally at least about 15 weight percent, and frequently at least about 25 weight percent. Normally, the moisture content of the extract does not exceed about 90 weight percent, and frequently does not exceed about 80 weight percent.

The moist tobacco extract can be contacted with a substrate. Preferred substrates are normally solid materials and are thermally stable at those temperatures experienced during the heat treatment steps of the present invention. Examples of suitable substrate materials include porous carbons, carbon fibers, carbon yarns, high surface area glass beads, aluminas, clays, and the like. Typical substrates are aluminas available as D-2 Sintered Alpha Alumina from W. R. Grace & Co. and carbon yarns available as Kynol Catalogue No. CFY-020Y-3 from American Kynol, Inc. Furthermore, the moist tobacco extract can be contacted with an organic liquid. Examples of organic liquids include polyhydric alcohols (e.g., glycerin and propylene glycol).

The tobacco extract normally includes a wide variety of flavorful tobacco components. If desired, flavoring agents (e.g., cocoa, licorice, St. John's bread, spices, herbs, and the like) can be added to the tobacco extract. Certain amounts of sugars (e.g., fructose, sucrose, glucose, maltose) can be added to the tobacco extract.

Certain amounts of amino acids and amino acid analogs (e.g., glutamine, asparagine, proline, alanine, cystine, aspartic acid, phenylalanine, glutamic acid) can be added to the tobacco extract. If desired, sugars as well as amino acids or amino acid analogs can be added to a tobacco extract.

The tobacco composition is subjected to moderately high temperature treatment. Typically, such treatment involves exposing the tobacco composition to a temperature above about 100° C., preferably above about 110° C., and more preferably above about 120° C. However, it is desirable to subject the tobacco composition to a temperature below about 250° C., more desirably below about 200° C., in order to avoid an undesirable formation of components which are deleterious to the taste characteristics of the tobacco composition.

The moderately high temperature treatment of the tobacco composition can be performed under an inert atmosphere. For example, nitrogen and argon gas can be employed in order to provide an inert atmosphere. However, the heat treatment can be conducted under ambient atmosphere (i.e., air).

The moderately high temperature treatment is performed in a pressure controlled environment. Such an environment is provided by enclosing the tobacco composition in an air sealed vessel or chamber. Typically, a pressure controlled environment is provided using a pressure vessel or chamber which is capable of withstanding relatively high pressures. Such vessels or chambers (i) provide enclosure or concealment of the tobacco composition such that volatile flavor components of the tobacco extract are not lost or do not otherwise escape during the moderately high temperature treatment step, and (ii) provide for treatment of the tobacco composition at a temperature significantly above about 100° C. Preferred pressure vessels are equipped with an external heating source. Examples of vessels which provide a pressure controlled environment include a Parr Reactor Model No. 4522 and a Parr Reactor Model No. 4552 available from The Parr Instrument Co. Operation of such exemplary vessels will be apparent to the skilled artisan. Typical pressures experienced by the tobacco composition during the process of the present invention range from about 10 psig to about 1,000 psig, normally from about 20 psig to about 500 psig.

The amount of time that the tobacco composition is subjected to the moderately high temperature treatment can vary. Normally, the time period is sufficient to heat an entire tobacco composition at the desired temperature for a period of at least about 10 minutes, preferably at least about 20 minutes. Normally, the time period is less than about 3 hours, preferably less than about 1 hour. However, it is desirable to control the time/temperature profile of tobacco compositions subjected to heat treatment so that each tobacco composition is not subjected to a particularly high temperature for a lengthy period of time. It is highly desirable to employ a pressure vessel design or a vessel equipped with an agitation mechanism such that the tobacco composition experiences a relatively uniform temperature throughout the treatment period. In particular, it is highly desirable for the entire tobacco composition to be heated uniformly throughout as much as possible at the maximum temperature to which the tobacco composition is subjected.

Conditions provided during the process of the present invention most desirably are such that certain components of the tobacco extract undergo Maillard or Browning Reactions. Such reactions are reactions between (i) the amino substituents of amino acids, peptides, proteins or other nitrogen-containing compounds, and (ii) the carbonyl group of a sugar in the reducing form or other carboxyl-containing compounds. Such reactions result in a significant darkening of the tobacco extract, typically to an extremely dark brown color. Such reactions often result in a moist tobacco extract of increased viscosity, particularly when the extract is subjected to relatively high temperature treatment for a relatively long period of time. See, Maillard, *Ana. Chim.*, Vol. 9, pp. 5 and 258 (1916); Hodge, *J. Agric. Food Chem.*, Vol. 1, p. 928 (1953); Nursten, *Food Chem.*, Vol. 6, p. 263 (1981) and Waller et al, *ACS Symp. Ser.* (1983).

After the tobacco composition has been subjected to the moderately high temperature treatment for the controlled period of time, the tobacco composition is collected. The tobacco composition is provided in various forms for use in the manufacture of smoking articles. For example, a heat-treated tobacco composition can be contacted with a liquid carrier such as glycerin, propylene glycol, ethanol, water, or the like, and employed as a form of tobacco in smoking article manufacture. Forms of heat-treated tobacco compositions can be applied directly to smokable materials. For example, tobacco cut filler, as well as the types of smokable materials described in U.S. Pat. application Ser. No. 276,161, filed Nov. 23, 1988, now U.S. Pat. No. 4,920,990 to Lawrence et al., can be blended with about 0.01 to about 10 weight percent of the heat-treated tobacco extract, based on the weight of the smokable material. Furthermore, the heat-treated tobacco composition having the form of substrate and tobacco extract can be dried, combined with other aerosol forming materials, and employed in the manufacture of those smoking articles described in U.S. Pat. Nos. 4,708,151 to Shelar; 4,771,795 to White et al; 4,714,082 to Banerjee et al; 4,756,318 to Clearman et al; and 4,793,365 to Sensabaugh et al; as well as European Patent Publication Nos. 212,234 and 277,519. In addition, the heat-treated tobacco compositions can be incorporated into those smoking articles described in U.S. Pat. application Ser. No. 414,833 filed Sept. 29, 1989 and European Patent Publication No. 280,990.

The following examples are provided in order to further illustrate various embodiments of the invention but should not be construed as limiting the scope thereof. Unless otherwise noted, all parts and percentages are by weight.

EXAMPLE 1

An aged flue-cured tobacco in cut filler form is extracted in a stainless steel tank at a concentration of about 1 pound of tobacco per gallon of water. The extraction is conducted at ambient temperature (e.g., about 20° C.) while mechanically agitating the mixture centrifuged to remove essentially all suspended solids. The aqueous extract is concentrated in a thin film evaporator to a concentration of about 30 percent dissolved solids. Thin film evaporation conditions are such that water is evaporated from the extract while loss of flavorful tobacco volatiles is minimized. The concentrated aqueous extract then is spray dried by continuously pumping the aqueous solution to an Anhydro Size No. 1 spray dryer. The dried powder is collected at the outlet of the dryer. The inlet temperature of the spray dryer is about 215° C., and the outlet temperature is about 82° C. The spray dried material is a brown, powdery material, and has a moisture content of about 5 percent to about 6 percent.

The spray dried extract is mixed with water. In particular, about 175 g of the extract is mixed with about 200 g of water. The resulting moist extract is contacted with about 50 g high fructose corn syrup and about 50 g asparagine in a Parr Reactor Model No. 4522 equipped with a temperature control unit available as Parr No. 4842-PID from The Parr Instrument Co. As such, the resulting tobacco composition within the pressure vessel weighs about 475 g. The pressure vessel is equipped with a mechanical stirrer. The moist extract then is subjected to exposure to a maximum temperature of about 125° C. for about 30 minutes at a pressure of about 30 psig. Then, the tobacco composition is removed from the pressure vessel. The tobacco composition exhibits an extremely dark brown color and a pleasant aroma.

The heat-treated tobacco composition is employed as a tobacco component for a cigarette which heats, but does not burn tobacco. The cigarette employs a short, carbonaceous fuel element, a 38 mm long aluminum capsule filled with alpha alumina beads in a heat exchange relationship with the fuel element, a roll of volume expanded Burley tobacco roll surrounding the capsule, a pleated section of tobacco paper, and a low efficiency polypropylene web filter. Such a cigarette is described in *Chemical and Biological Studies on New Cigarette Prototypes that Heat Instead of Burn Tobacco*, R. J. Reynolds Tobacco Co., (1988). The alpha alumina beads are available as D-2 Sintered Alpha Alumina from W. R. Grace & Co.

To the alpha alumina beads of the cigarette is applied the heat-treated tobacco composition in an amount of 1 part tobacco extract to 20 parts beads. The beads also carry glycerin. Then, 300 mg of the treated alpha alumina beads are incorporated into the aluminum capsule of the cigarette.

EXAMPLE 2

Spray dried tobacco extract is provided as described in Example 1. The spray dried extract is contacted with water. In particular, about 175 g of the extract is mixed with about 200 g water. The resulting moist extract is contacted with about 50 g asparagine in the pressure vessel described in Example 1. The resulting tobacco composition then is subjected to exposure to a maximum temperature of about 110° C. for about 30 minutes at a pressure of about 15 psig. The tobacco composition then is removed from the pressure vessel. The tobacco composition exhibits an extremely dark brown color and a pleasant aroma.

EXAMPLE 3

Spray dried tobacco extract is provided as described in Example 1. The spray dried extract is contacted with water. In particular, about 135 g of the extract is mixed with about 154 g water. The resulting moist extract is contacted with 39 g asparagine in the pressure vessel described in Example 1. The resulting tobacco composition then is subjected to exposure to a maximum temperature of about 140° C. for about 30 minutes at a pressure of about 75 psig. The tobacco composition then is removed from the pressure vessel. The tobacco composition exhibits an extremely dark brown color and a pleasant aroma.

EXAMPLE 4

Spray dried tobacco extract is provided as described in Example 1. The spray dried extract is contacted with water. In particular about 175 g of the extract is mixed with about 200 g water in the pressure is subjected to exposure to a maximum temperature of about 110° C. for about 30 minutes at a pressure of about 30 psig. The tobacco composition then is removed from the pressure vessel. The tobacco composition exhibits an extremely dark brown color and a pleasant aroma.

EXAMPLE 5

Spray dried tobacco extract is provided as described in Example 1. The spray dried extract is contacted with water. In particular about 175 g of the extract is mixed with about 200 g water in the pressure vessel described in Example 1. The moist extract then is subjected to exposure to a maximum temperature of about 130° C. for about 30 minutes at a pressure of about 60 psig. The tobacco composition then is removed from the pressure vessel. The tobacco composition exhibits an extremely dark brown color and a pleasant aroma.

EXAMPLE 6

Spray dried tobacco extract is provided as described in Example 1. The spray dried extract is contacted with water. In particular, about 175 g of the extract is mixed with about 200 g water. The resulting moist extract is contacted with about 50 g asparagine in the pressure vessel described in Example 1. The resulting tobacco composition then is subjected to exposure to a maximum temperature of about 130° C. for about 30 minutes at a pressure of about 70 psig. The tobacco composition then is removed from the pressure vessel. The tobacco composition exhibits an extremely dark brown color and a pleasant aroma.

EXAMPLE 7

Spray dried tobacco extract is provided as described in Example 1. The spray dried extract is contacted with water. In particular, about 175 g of the extract is mixed with about 200 g water. The resulting moist extract is contacted with about 50 g asparagine in the pressure vessel described in Example 1. The tobacco composition then is subjected to exposure to a maximum temperature of about 110° C. for about 30 minutes at a pressure of about 35 psig. The tobacco composition then is removed from the pressure vessel. The tobacco composition exhibits an extremely dark brown color and a pleasant aroma.

EXAMPLE 8

Spray dried tobacco extract is provided as described in Example 1. The spray dried extract is contacted with water. In particular, about 175 g of the extract is mixed with about 200 g water. The resulting moist extract is contacted with about 50 g glutamine in the pressure vessel described in Example 1. The resulting tobacco composition then is subjected to exposure to a maximum temperature of about 130° C. for about 30 minutes at a pressure of about 60 psig. The tobacco composition then is removed from the pressure vessel. The tobacco composition exhibits an extremely dark brown color and a pleasant aroma.

EXAMPLE 9

Spray dried Burley tobacco extract is provided by extracting Burley tobacco in cut filler form using equipment and procedures generally as described in Example 1. The spray dried extract is contacted with water. In particular, about 175 g of the extract is mixed with about 200 g water. The resulting moist extract is contacted with about 50 g asparagine in the pressure vessel described in Example 1. The resulting tobacco composition then is subjected to exposure to a maximum temperature of about 130° C. for about 30 minutes at a pressure of about 60 psig. The tobacco composition then is removed from the pressure vessel. The tobacco composition exhibits an extremely dark brown color and a pleasant aroma.

EXAMPLE 10

Spray dried Burley tobacco extract is provided by extracting Burley tobacco in cut filler form using equipment and procedures generally as described in Example 1. The spray dried extract is contacted with water. In particular, about 175 g of the extract is mixed with about 200 g water. The resulting moist extract is contacted with about 50 g glutamine in the pressure vessel described in Example 1. The tobacco composition then is subjected to exposure to a maximum temperature of about 130° C. for about 30 minutes at a pressure of about 60 psig. The tobacco composition then is removed from the pressure vessel. The tobacco composition exhibits an extremely dark brown color and a pleasant aroma.

EXAMPLE 11

Spray dried Burley tobacco extract is provided by extracting Burley tobacco in cut filler form using equipment and procedures generally as described in Example 1. The spray dried extract is contacted with water. In particular, about 175 g of the extract is mixed with about 200 g water in the pressure vessel described in Example 1. The moist extract then is subjected to exposure to a maximum temperature of about 130° C. for about 30 minutes at a pressure of about 60 psig. The tobacco composition then is removed from the pressure vessel. The tobacco composition exhibits an extremely dark brown color and a pleasant aroma.

EXAMPLE 12

A spray dried tobacco extract is provided by extracting tobacco dust collected from a cigarette making machine using equipment generally as described in Example 1. The spray dried extract is contacted with water. In particular, about 175 g of the extract is mixed with about 200 g water. The resulting moist extract is contacted with about 50 g glutamine in the pressure vessel described in Example 1. The tobacco composition then is subjected to exposure to a maximum temperature of about 130° C. for about 30 minutes at a pressure of about 30 psig. The tobacco composition then is removed from the pressure vessel. The tobacco composition exhibits an extremely dark brown color and a pleasant aroma.

EXAMPLE 13

Spray dried tobacco extract is provided as described in Example 12. The spray dried extract is contacted with water. In particular, about 175 g of the extract is mixed with about 400 g water. The resulting moist extract is contacted with about 50 g asparagine in the pressure vessel described in Example 1. The tobacco composition then is subjected to exposure to a maximum temperature of about 180° C. for about 30 minutes at a pressure of about 200 psig. The tobacco composition then is removed from the pressure vessel. The tobacco composition exhibits an extremely dark brown color and a pleasant aroma.

EXAMPLE 14

Spray dried tobacco extract is provided as described in Example 12. The spray dried extract is contacted with water. In particular, about 175 g of the extract is mixed with about 400 g water in the pressure vessel described in Example 1. The moist extract then is subjected to exposure to a maximum temperature of about 180° C. for about 30 minutes at a pressure of about 160 psig. The tobacco composition then is removed from the pressure vessel. The tobacco composition exhibits an extremely dark brown color and a pleasant aroma.

EXAMPLE 15

Spray dried tobacco extract is provided as described in Example 12. The spray dried extract is contacted with water. In particular, about 175 g of the extract is mixed with about 400 g water. The resulting moist extract is contacted with about 50 g glutamine in the pressure vessel described in Example 1. The tobacco composition then is subjected to exposure to a maximum temperature of about 180° C. for about 30 minutes at a pressure of about 180 psig. The tobacco composition then is removed from the pressure vessel. The tobacco composition exhibits an extremely dark brown color and a pleasant aroma.

EXAMPLE 16

A mixture of about 60 parts water and about 40 parts glycerin is suspended with about 14.3 parts of the tobacco composition collected in Example 15. The resulting mixture is sprayed onto reconstituted tobacco strip such that the tobacco strip has about 0.5 percent heat treated tobacco extract applied thereto. The reconstituted tobacco strip is provided using a papermaking process, and includes about 42 parts calcium carbonate, about 3.5 parts flax and about 54.5 parts of a blend of flue cured, Burley and Oriental tobaccos. The strip then is air dried to about a 13 percent moisture level, and is shredded at about 32 cuts per inch into cut filler form. The cut filler is used to manufacture a filter cigarette having a circumference of about 24.85 mm, a tobacco rod length of about 57 mm, and a filter element length of about 27 mm. The cut filler within each cigarette weighs about 803 mg, and the paper wrap of the tobacco rod is available as PP-2123-1-114 from Kimberly-Clark Corp. The cigarette is smoked and yields mainstream smoke high in tobacco flavor.

EXAMPLE 17

A filter rod of about 120 mm length and about 24.55 mm circumference is provided. The filter material within each rod is a gathered web of nonwoven polypropylene sheet available as PP-100 from Kimberly-Clark Corp. The filter material within each rod weighs about 0.964 g. The gathered filter material circumscribed by a nonporous paper plug wrap available as Ref. No. 646 from Ecusta Corp. The filter rod is manufactured using the apparatus generally described in Example 1 of U.S. Pat. No. 4,807,809 to Pryor et al.

The tobacco composition collected in Example 15 is applied to the filter rod. In particular, the tobacco composition is passed through a small funnel placed at one end of the filter rod, and is allowed to drain through the filter rod. The filter rod then is air dried to constant weight. The filter rod experiences a weight increase of about 58 mg.

The filter rod is divided into filter segments of 21 mm length, and each segment is combined with a tobacco rod of 64 mm length to provide a filter cigarette. The cigarette is smoked and yields mainstream smoke high in tobacco flavor.

EXAMPLE 18

Paper/foil inner laminate liners for cigarette packages available as 26035-01 004-7863 from The Archer Co. are contacted with the tobacco composition collected in Example 15 which has been diluted with water. The diluted tobacco composition includes about 5 parts water and about 1 part heat treated extract. The diluted tobacco composition is printed onto the paper side of the paper/foil liner. The liner is dried, and the liner experiences a weight increase of about 4 percent. The liners then are used to package cigarettes. The cigarettes packaged in such packages exhibit a highly pleasant tobacco rod aroma. The "pack aroma" of such packages is increased over similar packages not combined with the heat-treated composition.

EXAMPLE 19

Spray dried tobacco extract is provided as described in Example 12. The spray dried extract is contacted with water. In particular, about 175 g of the extract is mixed with about 400 g water. The resulting moist extract is contacted with 50 g proline in the pressure vessel described in Example 1. The tobacco composition then is subjected to exposure to a maximum temperature of about 180° C. for about 30 minutes at a pressure of about 200 psig. The tobacco composition then is removed from the pressure vessel. The tobacco composition exhibits an extremely dark brown color and a pleasant aroma.

EXAMPLE 20

Spray dried tobacco extract is provided as described in Example 12. The spray dried extract is contacted with water. In particular, about 175 g of the extract is mixed with about 400 g water. The resulting moist extract is contacted with about 50 g glutamic acid in the pressure vessel described in Example 1. The tobacco composition then is subjected to exposure to a maximum temperature of about 180° C. for about 30 minutes at a pressure of about 170 psig. The tobacco composition then is removed from the pressure vessel. The tobacco composition exhibits an extremely dark brown color.

EXAMPLE 21

Spray dried tobacco extract is provided as described in Example 12. The spray dried extract is contacted with water. In particular, about 175 g of the extract is mixed with about 400 g water. The resulting moist extract is contacted with 50 g alanine in the pressure vessel described in Example 1. The tobacco composition then is subjected to exposure to a maximum temperature of about 180° C. for about 30 minutes at a pressure of about 180 psig. The tobacco composition then is removed from the pressure vessel. The tobacco composition exhibits an extremely dark brown color.

EXAMPLE 22

Spray dried tobacco extract is provided as described in Example 12. The spray dried extract is contacted with water. In particular, about 175 g of the extract is mixed with about 400 g water. The resulting moist extract is contacted with about 50 g phenylalanine in the pressure vessel described in Example 1. The tobacco composition then is subjected to exposure to a maximum temperature of about 180° C. for about 30 minutes at a pressure of about 200 psig. The tobacco composition then is removed from the pressure vessel. The tobacco composition exhibits an extremely dark brown color.

EXAMPLE 23

Spray dried tobacco extract is provided as described in Example 12. The spray dried extract is contacted with glycerin. In particular, about 175 g of the extract is mixed with about 400 g glycerin. The extract so provided has a moisture content of above about 8 percent in the pressure vessel described in Example 1. The extract and glycerin are contacted with 50 g glutamine. The resulting tobacco composition then is subjected to exposure to a maximum temperature of about 180° C. for about 30 minutes at a pressure of about 85 psig. The tobacco composition then is removed from the pressure vessel. The tobacco composition exhibits an extremely dark brown color and a pleasant aroma.

EXAMPLE 24

Spray dried tobacco extract is provided as described in Example 12. The spray dried extract is contacted with water. In particular, about 175 g of the extract is mixed with about 400 g of water. The resulting moist extract is contacted with about 50 g aspartic acid in the pressure vessel described in Example 1. The resulting tobacco composition then is subjected to exposure to a maximum temperature of about 180° C. for about 30 minutes at a pressure of about 245 psig. The tobacco composition then is removed from the pressure vessel. The tobacco composition exhibits an extremely dark brown color and a pleasant aroma.

EXAMPLE 25

Spray dried tobacco extract is provided as described in Example 12. The spray dried extract is contacted with glycerin. In particular, about 175 g of the extract is mixed with about 400 g glycerin. The resulting moist extract is contacted with about 50 g glycerin. The extract so provided has a moisture content of above about 8 percent. The extract and glycerin are contacted with about 50 g asparagine in the pressure vessel described in Example 1. The tobacco composition then is subjected to exposure to a maximum temperature of about 160° C. for about 30 minutes at a pressure of about 80 psig. The tobacco composition then is removed from the pressure vessel. The tobacco composition exhibits an extremely dark brown color and a pleasant aroma.

What is claimed is:

1. A process for altering the chemical nature of a tobacco extract, the process comprising the steps of:

(a) extracting tobacco material with an extraction solvent to provide a tobacco extract, (b) providing the tobacco extract within a liquid having an aqueous character such that the moisture content thereof is at least about 5 percent, based on the total weight of the solvent and extract, (c) subjecting the tobacco extract to heat treatment at above ambient pressure (i) in a pressure controlled environment, and (ii) at a temperature above about 100° C.

2. The process of claim 1 whereby the extraction solvent is a liquid having an aqueous character.

3. The process of claim 1 or 2 including providing the tobacco extract in step (b) such that the moisture content thereof is at least about 15 percent.

4. The process of claim 1 or 2 including providing the tobacco extract in step (b) such that the moisture content thereof is at least about 25 percent.

5. The process of claim 1 or 2 whereby the extract is subjected to heat treatment at a temperature below about 250° C.

6. The process of claim 5 whereby the extract is subjected to heat treatment at a temperature above about 120° C.

7. The process of claim 1 or 2 whereby the extract is subjected to heat treatment at a temperature above about 110° C.

8. The process of claim 1 or 2 whereby the extract is subjected to heat treatment at a temperature above about 120° C.

9. The process of claim 8 whereby the extract is subjected to heat treatment at a pressure of about 20 psig to about 500 psig.

10. The process of claim 1 or 2 whereby the extract is subjected to heat treatment at a pressure of about 10 psig to about 1,000 psig.

11. The process of claim 1 or 2 whereby the extract is subjected to heat treatment at a pressure of about 20 psig to about 500 psig.

12. The process of claim 1 or 2 whereby tobacco extract is contacted with at least one sugar prior to heat treatment.

13. The process of claim 12 whereby the tobacco extract is contacted with at least one amino acid prior to heat treatment.

14. The process of claim 12 whereby the tobacco extract is contacted with at least one amino acid analog prior to heat treatment.

15. The process of claim 1 or 2 whereby the tobacco extract is contacted with at least one amino acid prior to heat treatment.

16. The process of claim 2 including providing the extract in step (b) such that the moisture content thereof does not exceed about 90 percent.

17. The process of claim 15 including providing the tobacco extract in step (b) such that the moisture content thereof is at least about 25 percent.

18. The process of claim 1, 2, 15 or 16 whereby the extract is subjected to heat treatment under inert atmosphere.

19. The process of claim 1 or 2 whereby the tobacco extract is contacted with at least one amino acid analog prior to heat treatment.

20. The process of claim 2, 15, or 16 whereby the tobacco extract as provided is a spray dried form prior to step (b).

21. The process of claim 1, 2, 15 or 16 whereby the tobacco extract is provided at a predetermined solvent level by evaporation of the solvent prior to step (b).

* * * * *